United States Patent [19]

Lemery

[11] 4,387,615

[45] Jun. 14, 1983

[54] ANTI-KICK SAW CHAIN AND A KICK-REDUCING METHOD

[75] Inventor: Douglas J. Lemery, Victoria, Canada

[73] Assignee: Kolve Sawchain Company, Portland, Oreg.

[21] Appl. No.: 321,403

[22] Filed: Nov. 16, 1981

[51] Int. Cl.[3] ..... B27B 33/14

[52] U.S. Cl. ..... 83/56; 83/833; 83/834

[58] Field of Search ..... 83/56, 830–834

[56] References Cited

U.S. PATENT DOCUMENTS

| | | | |
|---|---|---|---|
| 3,745,870 | 7/1973 | Lemery | 83/833 |
| 3,951,027 | 4/1976 | Arff | 83/834 |
| 4,074,604 | 2/1978 | Goldblatt | 83/830 |

*Primary Examiner*—James M. Meister

*Attorney, Agent, or Firm*—Seed, Berry, Vernon & Baynham

[57] ABSTRACT

To reduce the possibility of a kick by a chain saw when cutting on the end of the bar, this invention provides cutter elements having spurs to cock the elements when the elements engage the idler sprocket on the end of the bar. As the elements begin to move in an arc around the idler sprocket, the spurs ensure that the leading depth gauge of the element does not fall away to expose the trailing teeth to too great a depth of cut. Instead, at any position in the arc, the spurs ensure that the depth between the depth gauge and the tooth of each element remains substantially no greater than the depth between the depth gauge and the tooth when the element is moving in a straight line. Preferably, the spur cocks the element so that the depth gauge is effectively higher than the tooth (i.e., the radius of the arc of the outside edge of the depth gauge is larger than the radius of the arc of the outside edge of the tooth). Both the novel cutter elements and a method of reducing the possibility of a kick are disclosed.

13 Claims, 2 Drawing Figures

ANTI-KICK SAW CHAIN AND A KICK-REDUCING METHOD

TECHNICAL FIELD

This invention relates to saw chains for use on chain saws. More particularly, this invention relates to a new and improved saw chain, including novel cutting elements which reduce the possibility of a kick by the chain saw when cutting on the end of the bar.

BACKGROUND ART

When a cutting element is pulled around the arc (radius) of the end of the bar of a chain saw, the depth gauge follows the arc of the bar ahead of the cutting tooth of the cutter element. Because the depth gauge follows the arc, the cutting tooth is exposed to a greater depth of cut than desired (sometimes becoming as much as 0.120 inch below the tooth instead of the desired 0.030 inch). The cutting tooth dives into the wood and removes a chip thicker than desired as governed by the relative heights of the depth gauge and the cutting tooth when running in a straight line along the bar. Either the chain saw will kick either upwardly or backwardly, or the operator will need to apply substantially greater pressure to counter the tendency of the chain saw to move either upwardly or backwardly. Thus, for the common cutter element, the arc around the end of the bar makes the leading depth gauge ineffective as an accurate gauge for setting the depth of cut for the trailing cutting tooth.

DISCLOSURE OF INVENTION

A novel cutter element for a saw chain reduces the possibility of kicking by a chain saw when the cutter element travels around the idler sprocket on the end of the bar. The cutter element has a spur extending laterally outwardly from the body of the cutter element in the same direction as the root to engage an idler sprocket tooth on the end of the bar and to cock the cutter element so that, when the cutter element moves without obstruction around the end of the bar, the relative distance between the leading depth gauge of the cutter element and the trailing cutter tooth is substantially no greater than the relative distance between the leading depth gauge and the trailing cutter tooth when the saw chain is moving in a straight line along the bar. Cocking the cutter element to maintain this desired depth gauge/cutting tooth relationship ensures that the cutting tooth of each cutter element will cut a chip of wood no thicker than the chips it ordinarily cuts. The cocking also ensures that the cutting tooth does not tend to dive into the wood and tend to cut thicker chips, which leads to a kick (strong shock) for the chain saw. Ordinarily, the spur of the cutter element will cock the cutter element so that the relative depth between the depth gauge and cutting tooth is less than the depth when the saw chain is moving in a straight line along the bar. In fact, in most circumstances, the cutter element will be cocked at an angle so that the depth gauge effectively is higher than the cutting tooth by as much as about 0.005–0.010 inch when passing without obstruction around the end of the bar. The depth gauge is deemed to be higher than the cutting tooth when the radius of an arc circumscribed by the outside edge of the depth gauge is larger than the radius of the arc circumscribed by the cutting tooth's outside edge.

A chain saw having a higher depth gauge than cutting tooth when passing around the idler sprocket at the end of a bar may still be used to bore into wood. The preferred spur on a cutter element of this invention allows the cutter element to pivot around the trailing rivet (which passes through the body of the cutter element) when a radially inward pressure is applied to the cutter element (such as when the operator bores with the chain saw). Thus, under the influence of an inwardly directed pressure, the saw chain will actually cut while passing around the end of the bar, because cocking of the element will be altered. When freely idling, however, the spur initially cocks the cutter element so that the depth gauge is higher than the cutting tooth. Much safer chain saw operation is provided with the novel cutter elements and method of this invention because the possibility of kicking is substantially eliminated.

BEST MODE FOR CARRYING OUT THE INVENTION

U.S. Pat. No. 3,745,870 is incorporated by reference into this disclosure.

Figure 1:
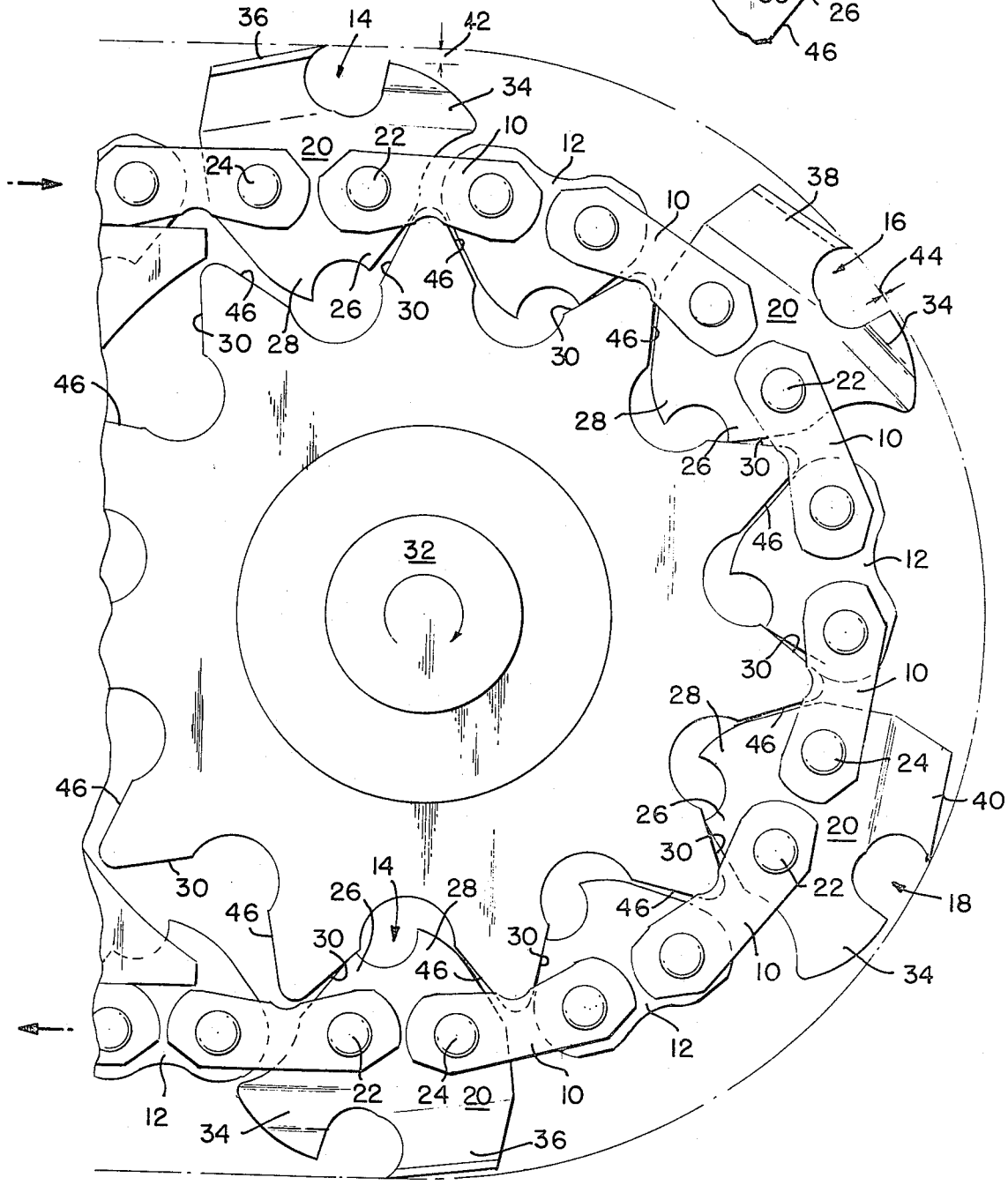
FIG. 1 is a partial schematic detail of a saw chain of this invention passing around the end of a bar of a chain saw.

As shown in FIG. 1, the saw chain of a chain saw has a plurality of pivotally joined links forming an endless belt of side links 10, spacer links 12, and cutter elements 14, 16, and 18. Some cutter elements are right-hand raker teeth 14; other cutter elements are left-hand raker teeth 16; and some cutter elements are side cutter elements 18. Each cutter element 14, 16 and 18 has a body portion 20 which includes holes for a front rivet 22 and a trailing rivet 24. The side links 10 are riveted to the cutter elements 14, 16, and 18, and the cutter elements are normally separated by spacer links 12, as shown in FIG. 1.

Figure 2:
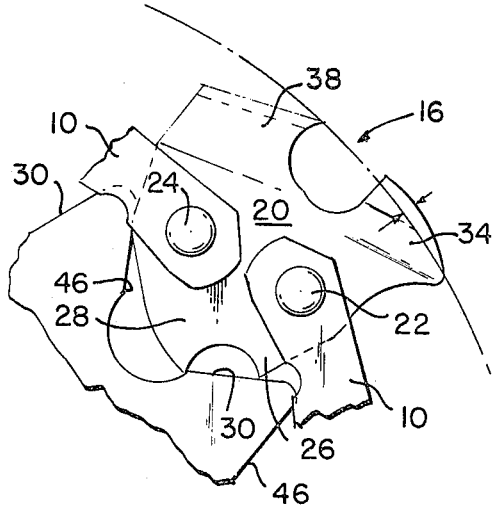
FIG. 2 is a partial schematic detail, similar to FIG. 1, showing a cutter element cocked so that the depth gauge is effectively higher than the cutting tooth.

Extending laterally outwardly from the body 20 of a cutter element 14, 16 or 18 on one side of the body 20 are a leading spur 26 and a trailing, sprocket-engaging root 28. The spur 26 initially engages the trailing edge 30 of a sprocket tooth on the idler sprocket 32 at the end of the bar of a chain saw. The spur 26 cocks the cutter element so that, when the cutter element moves around the end of the bar, the depth between the leading depth gauge 34 of the cutter element (which may include an offset depth gauge) and the trailing tooth (be it a right-hand raker cutting element 36, a left-hand raker cutting element 38, or a U-tooth side cutter element 40) is substantially no greater than the depth between the leading depth gauge 34 and the trailing tooth when the saw chain is moving in a straight line along the bar. That is, the difference in the radius of the arc of the outside edge of the depth gauge 34 as it travels around the idler sprocket 32 and the radius of arc of the outside edge of the trailing tooth 36, 38, or 40 is substantially no greater than the distance between the depth gauge and the trailing tooth when the chain is moving in a straight line. The customary depth or distance just defined is best shown with reference to numeral 42 in FIG. 1. As shown by reference numeral 44 in FIG. 1, as the cutting element proceeds around the arc on the idler sprocket 32, the effective distance between the depth gauge 34 and the trailing tooth 36, 38, or 40 is diminished. In fact, it is preferred that the depth gauge actually become effectively higher than the trailing tooth by about as much as 0.005–0.010 inch (as shown in FIG. 2). Of course, the depth gauge can only be higher than the tooth when the saw chain is not cutting (i.e, when idling the chain saw in the air).

When the leading depth gauge 34 and the trailing tooth have substantially the same outside radial arc circumscribed when they proceed around the idler sprocket 32 or when the depth gauge 34 is effectively higher than the trailing tooth, boring of the chain saw may still be accomplished because the spur 26 allows the cutter element to pivot about the trailing rivet 24 when a radially inwardly directed force is applied to the cutter element (as when boring with the chain saw). The cutter element will move backwardly so that the root portion 28 engages the leading edge 46 of a tooth of the idler sprocket 32. The cutter element is then constrained from exposing an overly large distance between the depth gauge 34 and the tooth 36, 38, or 40. Although a kick is possible, the likelihood of a kick occurring is greatly reduced. A general thickening of the forward portion of the body or an alteration to the trailing edge 30 of the idler sprocket will also accomplish the cocking function described for the spur 26.

Proper functioning of the cutter elements of this invention is easily accomplished because, ordinarily, the saw chain is pulled around the idler sprocket 32 by a drive sprocket housed in the engine portion of the chain saw (not shown). Thus the chain is pulled ahead at the top of the arc so that the spur 26 properly engages the trailing edge 30 of the tooth of the idler sprocket 32. The cocking confirmation is positively and automatically obtained in this manner.

To raise the leading depth gauge 0.035 inch when a tooth passes around the idler sprocket on the bar, for ⅜-inch pitch saw chain, the spur is defined by a chord 0.49 inch running from the center of the trailing rivet hole to the front of the element in the spur area. This chord will be angled below the horizontal by about 10° (if the measurement is taken as through the element were running in a straight line along the bar). The chord from the center of the trailing rivet hole to the rearward tip of the depth gauge will be about 0.58 inch at an angle of about 44° above the horizontal. If set to a 0.030-inch depth of cut, the element will effectively run 0.005 inch higher than the trailing tooth when moving around the bar.

I claim:

1. A method for reducing the possibility of a kick by the saw chain of a chain saw when cutting on the end of the chain saw's bar, wherein the saw chain includes a plurality of cutter elements forming an endlesses belt and wherein the elements each include a leading depth gauge and a trailing tooth, comprising the steps of:

(a) pulling the saw chain to engage a cutter element with a tooth of an idler sprocket on the end of the bar of the chain saw; and (b) cocking the cutter element as the cutter element begins to move in an arc around the end of the bar to ensure that the distance between the leading depth gauge and trailing tooth is no greater than the distance between the leading depth gauge and trailing tooth when the saw chain is moving in a straight line.

2. The method of claim 1 wherein the step of cocking the cutter element includes ensuring that the relative distance between the leading depth gauge and trailing tooth is less than the distance between the leading depth gauge and trailing tooth when the saw chain is moving in a straight line.

3. The method of claim 1 wherein the step of cocking the cutter element includes ensuring that the leading depth gauge and trailing tooth have substantially the same outside radial arc so that the depth gauge and tooth are effectively substantially at the same cutting height.

4. The method of claim 1 wherein the step of cocking the cutter element includes ensuring that, when idling on a chain saw, the leading depth gauge defines an outside radial arc of greater radius than the trailing tooth so that the depth gauge is effectively higher than the tooth during travel around the end of the bar.

5. The method of claim 1 wherein the depth gauge is effectively between about 0.005–0.010 inch higher than the tooth.

6. A cutter element for a saw chain to reduce the possibility of kicking by a chain saw when the cutter element travels around the end of the bar, comprising:

(a) a cutter element body;

(b) a sprocket-engaging robot extending from the body;

(c) a depth gauge extending laterally outwardly from the body in a direction opposite the root;

(d) a tooth extending laterally outwardly from the body in a direction opposite the root, yet trailing the depth gauge; and (e) a spur extending laterally outwardly from the body in the same direction as the root, yet leading the root, to engage an idler sprocket on the end of the bar and to cock the cutter element so that, when the cutter element moves in an arc around the end of the bar, the relative distance between the leading depth gauge and trailing tooth is substantially no greater than the distance between the leading depth gauge and trailing tooth when the saw chain is moving in a straight line.

7. The cutter element of claim 6 wherein the tooth is a raker cutting element.

8. The cutter of claim 7 wherein the depth gauge is offset from the centerline of the saw chain.

9. The cutter element of claim 6 wherein the tooth is a side cutter element.

10. The cutter element of claim 9 wherein the side cutter element is a composite of two separate, mirror-image links, each link having its own root, body, spur, depth gauge, and side cutter element.

11. The cutter element of claim 6 wherein the spur allows the cutter element to pivot around a trailing rivet through the body of the element when a radially inward pressure is applied to the cutter as when boring with the chain saw.

12. A saw chain to reduce the possibility of kicking when a cutter element travels around the end of the bar, comprising a plurality of pivotally joined links forming an endless belt of cutter elements, each cutter element having center links connected to another cutter element by side links, wherein each center link has (a) a body;

(b) a sprocket-engaging root extending from the body;

(c) a depth gauge extending laterally outwardly from the body in a direction opposite the root;

(d) a tooth extending laterally outwardly from the body in a direction opposite the root, yet trailing the depth gauge; and (e) a spur extending laterally outwardly from the body in the same direction as the root, yet leading the root, to engage an idler sprocket on the end of the bar and to cook the cutter element so that, when the cutter element moves in an arc around the end of the bar, the relative distance between the leading depth gauge and trailing tooth is substantially no greater than the depth between the leading depth gauge and trailing tooth when the saw chain is moving in a straight line.

13. The saw chain of claim 11 wherein the endless belt further has spacer links separating the cutter elements.

* * * * *

UNITED STATES PATENT AND TRADEMARK OFFICE

CERTIFICATE OF CORRECTION

PATENT NO. : 4,387,615

DATED : June 14, 1983

INVENTOR(S) : Douglas Lemery

It is certified that error appears in the above—identified patent and that said Letters Patent is hereby corrected as shown below:

Claim 6, line 5 of the claim, "robot" should be -- root --.

Signed and Sealed this

*Twenty-ninth* Day of *November 1983*

[SEAL]

*Attest:*

GERALD J. MOSSINGHOFF

*Attesting Officer*

*Commissioner of Patents and Trademarks*